US005303650A

United States Patent [19]

Wieland

[11] Patent Number: 5,303,650

[45] Date of Patent: Apr. 19, 1994

[54] SHEET GRIPPER ASSEMBLY

[75] Inventor: Erich G. Wieland, Wuerzburg, Fed. Rep. of Germany

[73] Assignee: Koenig & Bauer Aktiengesellschaft, Wurzburg, Fed. Rep. of Germany

[21] Appl. No.: 932,582

[22] Filed: Aug. 20, 1992

[30] Foreign Application Priority Data

Aug. 22, 1991 [DE] Fed. Rep. of Germany ..... 4127713

[51] Int. Cl.[5] ..... B41F 1/30

[52] U.S. Cl. ..... 101/409; 271/82; 271/204; 271/206; 198/803.7

[58] Field of Search ..... 101/408, 409, 410, 415, 101/378; 271/277, 204, 206, 82; 198/803.3, 803.4, 803.7, 803.8, 803.9

[56] References Cited

U.S. PATENT DOCUMENTS

| | | | |
|---|---|---|---|
| 2,906,204 | 9/1959 | Luehrs | 101/409 |
| 3,650,211 | 3/1972 | Nentwich | 101/409 |
| 4,224,873 | 9/1980 | Wieland | 101/409 |
| 4,253,396 | 3/1981 | Wieland | 271/82 |
| 4,381,056 | 4/1983 | Eberle | 271/204 |
| 4,592,279 | 6/1986 | Kemmerer | 198/803.7 |
| 4,647,031 | 3/1987 | Smith et al. | 271/82 |
| 4,681,213 | 7/1987 | Winiasz | 271/206 |
| 4,718,343 | 1/1988 | Genscheimer | 101/409 |
| 4,719,854 | 1/1988 | Ruger et al. | 101/409 |
| 4,846,061 | 7/1989 | Jeschke et al. | 271/206 |
| 5,048,815 | 9/1991 | Bergmeier et al. | 271/204 |

FOREIGN PATENT DOCUMENTS

| | | |
|---|---|---|
| 0213397 | 7/1986 | European Pat. Off. . |
| 3914646 | 5/1989 | Fed. Rep. of Germany . |

*Primary Examiner*—Eugene H. Eickholt
*Attorney, Agent, or Firm*—Jones, Tullar & Cooper

[57] ABSTRACT

A sheet gripper assembly includes a gripper shaft clamping member which is securely attachable to a gripper shaft. A gripper housing that includes a gripper arm and a gripper finger is secured to the gripper shaft clamping member through an elastic member. This elastic member provides a resilient or springy attachment of the gripper housing to the gripper shaft.

17 Claims, 3 Drawing Sheets

SHEET GRIPPER ASSEMBLY

FIELD OF THE INVENTION

The present invention is directed generally to a sheet gripper assembly. More particularly, the present invention is directed to a sheet gripper assembly for a sheet-fed rotary press. Most specifically, the present invention is directed to a sheet gripper assembly having a gripper housing attached by a clamping piece to a gripper shaft through a resilient member. The resilient member includes one or more metallic cross pieces which function as bearings. The resilient member is securely bonded to the inner surface of the gripper housing and to the outer surface of the gripper clamping piece. The interpositioning of the resilient member between the gripper housing and the clamping piece affords the gripper finger an ability to provide a springy gripping force against the gripper abutment surface so that the sheet being gripped can be held securely while not creating an undue amount of stress on the gripper fingers.

DESCRIPTION OF THE PRIOR ART

Sheet gripper assemblies for use with sheet-fed rotary printing presses are generally known in the art. In the conventional sheet gripper assembly, one or a plurality of sheet gripping fingers are secured directly to a gripper shaft. As the gripper shaft rotates through an arc of a circle, the gripper fingers move into and out of engagement with gripper abutment surfaces. So long as the movement of the gripper shaft is closely controlled, the gripper finger's gripper pressure area will engage a cooperating area of the gripper abutment surface with sufficient gripping force to securely hold a sheet of paper that is interposed between the gripper pressure area of the gripper finger and the corresponding gripper abutment surface area. If too much force is applied by causing the gripper shaft to overrotate, the gripper fingers may be damaged. If too little force is applied by causing the gripper shaft to underrotate, the sheet of paper may not be securely held between the gripper finger and the gripper abutment surface.

In European patent document EP 02 13 397 B2 there is disclosed a sheet gripper assembly in which the gripper fingers are attached to metallic spring elements so that there is provided a device for holding the sheet against the gripper abutment surface in a resilient manner. A limitation of this prior art device is its propensity to collect ink, paper dust, varnish and the like in the free spaces of the metallic spring elements. The accumulation of these contaminants in the open spring spaces hinders the resilient action of the spring.

Another prior art gripper finger assembly is shown in German patent document DE 39 14 646 A1. This prior art device shows gripper devices for a sheet-fed rotary press in which the fulcrum of the assembly is on an imaginary connecting line which passes between the gripper shaft center and the leading edge of the gripper finger. An elastic pad is provided above the fulcrum and this elastic pad provides a springy or resilient support for the gripper finger as it holds a sheet against the gripper abutment surface. In this prior art device the fulcrum is apt to deflect away form the imaginary connecting line when the gripper finger is forced against the gripper abutment surface with a greater force. This deflection of the fulcrum causes the gripper finger to slide or move with respect to the gripper abutment surface. The result is that the sheet being held between the gripper finger and its abutment surface may be caused to slide. This unwanted sliding displacement of the sheet can lead to printing inaccuracies as the sheet is moved through the rotary printing press.

Another limitation of this prior art device resides in the inability of the entire gripper pressure area to contact the gripper abutment surface area. This is because the fulcrum of the gripper does not align with the fulcrum of the gripper shaft.

A further limitation of this prior art device resides in the necessity of generating relatively large pressure forces because of the deformation of the elastic pad. Since this elastic pad is positioned in a gap between the gripper arm and the gripper finger, a large pressure force is required in order to bring the gripper to the lowest spring position.

It will thus be seen that a need exists for a sheet gripper which overcomes the limitations of the prior art devices. The sheet gripper assembly of the present invention provides such a device and is a significant improvement over the prior art devices.

SUMMARY OF THE INVENTION

It is an object of the present invention to provide a sheet gripper assembly.

Another object of the present invention is to provide a sheet gripper assembly for a sheet-fed rotary press.

A further object of the present invention is to provide a resiliently supported sheet gripper assembly.

Yet another object of the present invention is to provide a resiliently supported sheet gripper assembly which is not affected by dirt.

Even a further object of the present invention is to provide a resilient sheet gripper assembly in which the gripper finger does not exert a push on the sheet during closing of the gripper assembly.

Still another object of the present invention is to provide a resilient sheet gripper assembly in which the resiliency can be adjusted.

As will be discussed in greater detail in the description of the preferred embodiments which is set forth subsequently, the sheet gripper assembly in accordance with the present invention utilizes a gripper shaft clamping piece which is securely attached to a gripper shaft and a gripper housing which is secured to the clamping piece through an intermediate elastic or resilient member. This elastic member is bonded to both the clamping piece and to the gripper housing. One or more cross pieces, which preferably are of a metallic material, are secured to the elastic member and may act as bearings. The elastic member provides a resilient connection between the gripper shaft and the gripper housing through the clamping piece. This allows the gripper finger, which is part of the gripper housing to move resiliently with respect to the gripper shaft.

The sheet gripper assembly of the present invention provides a resilient support of the gripper finger and gripper housing on the gripper shaft in a sheet-fed rotary printing press in a manner which excludes dirt and other contaminants. The elastic member interposed between the gripper housing and the gripper shaft clamping piece does not have any voids or free spaces as was the case with the prior art spring. Thus no dirt, paper dust or other contaminant will collect to limit the resilient mounting of the gripper housing.

The fulcrum of the gripper is coincident with the fulcrum of the gripper shaft. The elastic member is interposed between the gripper housing and the gripper shaft generally in a concentric manner. This insures that the entire pressure area of the gripper finger engages the entire pressure area of the gripper abutment surface. There is area contact instead of point or line contact so that the paper will be securely held between the gripper finger and the gripper abutment surface.

The elastic member which is interposed between the gripper housing and the gripper shaft clamping member is not changed significantly in cross-sectional area due to the forces placed on it by the movement of the gripper housing and the gripper shaft clamping piece. This insures that the clamping force applied by the gripper finger will be proportional to the rotational distance of the gripper shaft.

The elastic member which is positioned between, and adhered to the inner circumference of the gripper housing and the outer circumference of the gripper shaft clamp is chosen so that it will not be affected by heat. This allows the sheet gripper assembly to be used in machines having dryers. The material may also be selected so that it will not be affected by fats, greases, washing solutions and the like. This allows the sheet gripper assembly to be used without problems in various printing units.

The sheet gripper assembly of the present invention provides an apparatus which overcomes the limitations of the prior art devices. As such, it is a substantial advance in the art.

BRIEF DESCRIPTION OF THE DRAWINGS

While the novel features of the sheet gripper assembly in accordance with the present invention are set forth with particularity in the appended claims, a full and complete understanding of the invention may be had by referring to the detailed description of the preferred embodiments which is presented subsequently, and as illustrated in the accompanying drawings in which:

DESCRIPTION OF THE PREFERRED EMBODIMENTS

Figure 1:
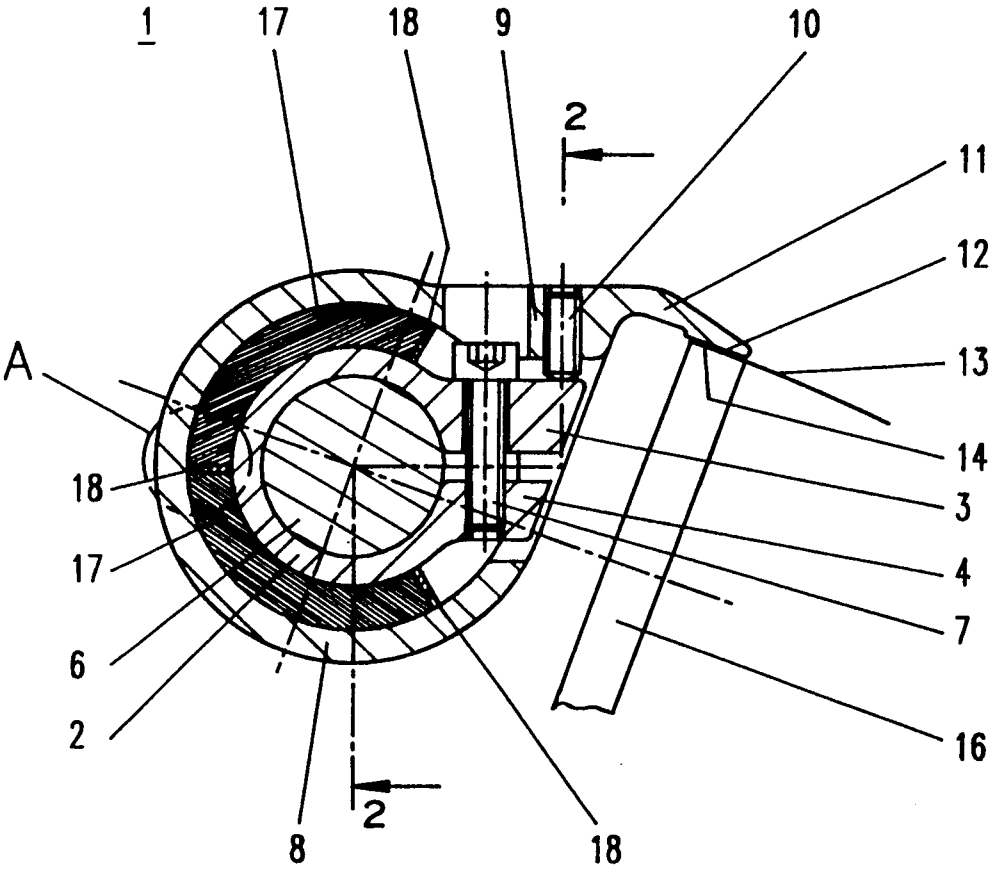
FIG. 1 is a cross-sectional view of a first preferred embodiment of a sheet gripper assembly in accordance with the present invention.
Figure 2:
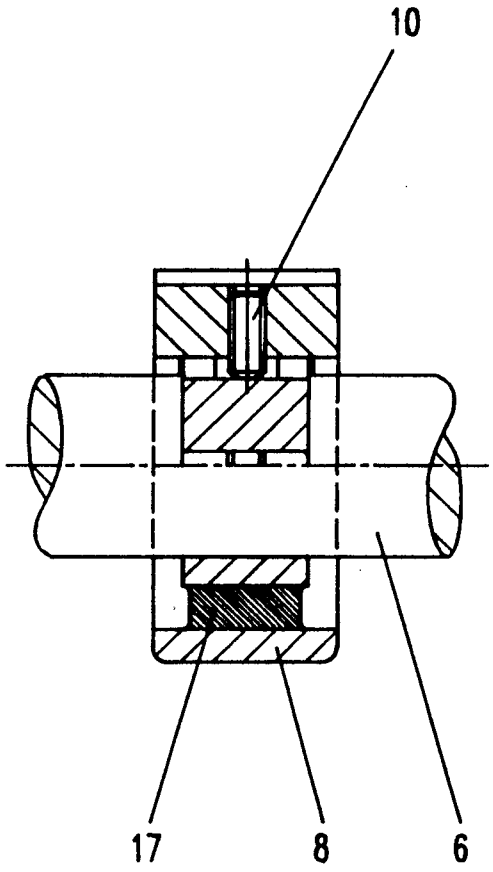
FIG. 2 is sectional view of the sheet gripper assembly of FIG. 1 and taken along line A—B in FIG. 1.

Referring initially to FIGS. 1 and 2, there may be seen generally at 1 a first preferred embodiment of a sheet gripper assembly in accordance with the present invention. Sheet gripper assembly 1 includes a gripper shaft clamping member 2 which is generally cylindrical in shape and is slidable over a generally conventional gripper shaft 6. It will be understood that gripper shaft 6 is typically rotatably supported in a sheet transfer or transport cylinder, not shown.

Gripper shaft clamping member 2 has a pair of outwardly extending butt straps or clamping ears 3 and 4. These two butt straps 3 and 4 have aligned threaded bores which receive a clamping screw 7. In this way, the gripper shaft clamping member 2 can be slid along a gripper shaft 6 to a desired location and then tightened in place using clamping screw 7.

A gripper housing, generally at 8 is generally concentric with, and encloses gripper shaft clamp 2 and gripper shaft 6. The gripper housing 8 has a gripper arm 9 which terminates in a gripper finger 11. The gripper finger 11 has a gripper pressure area 12 which engages a sheet 13 to be gripped and which holds the sheet 13 against a pressure area 14 of a gripper abutment surface, shown here somewhat schematically at 16.

An elastic member 17 is interposed between an outer circumferential surface of the gripper shaft clamp 2 and an inner circumferential surface of the gripper housing 8. The elastic member is separated into segments and is also bounded by cross pieces 18. These cross pieces extend radially outwardly from the outer circumference of the gripper shaft clamping piece 2 and act as bearings. These cross pieces 18 may be formed of metal. The elastic member 17 is bonded to the outer periphery of the gripper shaft clamp 2 and to the inner periphery of the gripper housing 8 by any suitable means. Thus there is no sliding between the inner surface of the elastic member 17 and the outer surface of the clamping piece 2. Similarly, there is no sliding movement between the outer surface of the elastic member 17 and the inner surface of the gripper housing 8. The elastic material used in the elastic member 17 can be natural rubber, silicone rubber, a chlorine containing rubber such as chloroprene rubber, polyurethane or the like. The specific elastic material utilized in the elastic member 17 will depend to some extent on the nature of the environment in which the gripper assembly will be used. Relative movement between the gripper shaft 6, the gripper shaft clamping piece 2 and the gripper housing 8 is a function of the resiliency of the elastic material used to form the elastic member 17. A preload can be applied to the gripper arm 9 to place a tension on the gripper arm 9 by use of a set screw 10 which is received in a threaded bore in the gripper arm and which engages an upper surface of the upper butt strap 3 of the gripper shaft clamping piece 2.

Figure 3:
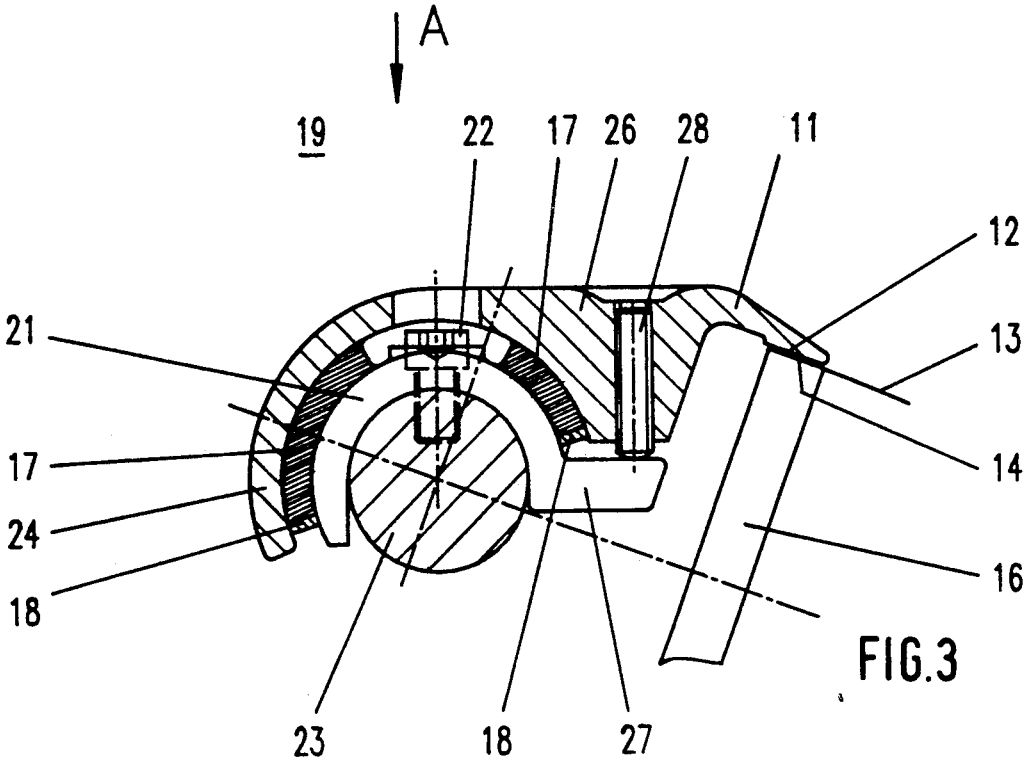
FIG. 3 is a cross-sectional view of a second preferred embodiment of a sheet gripper assembly in accordance with the present invention.
Figure 4:
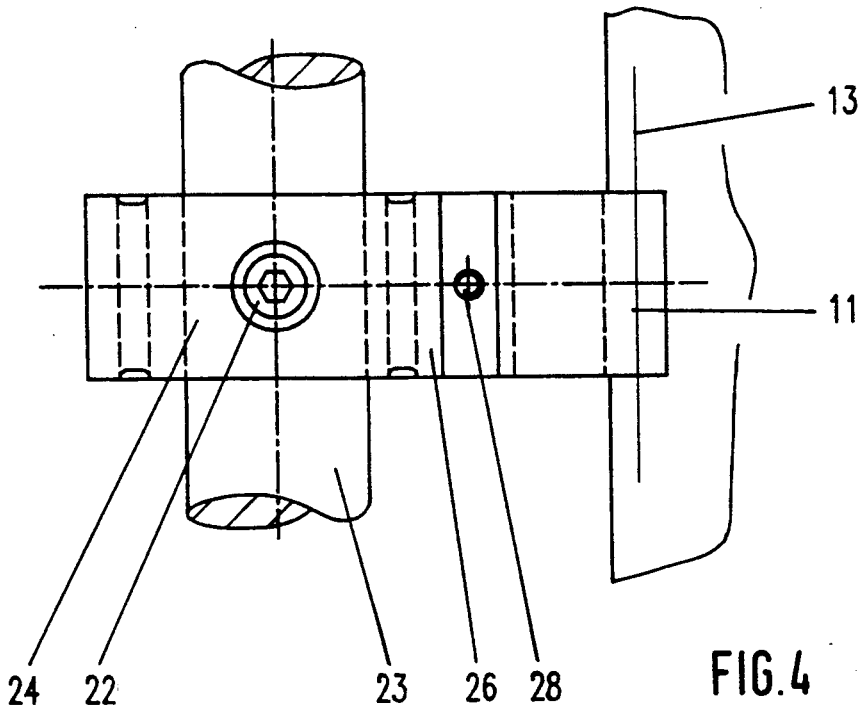
FIG. 4 is a top plan view of the assembly of FIG. 3, taken in the direction of arrow A in FIG. 3.

Turning now to FIGS. 3 and 4, there may be seen, generally at 19 a second preferred embodiment of a sheet gripper assembly in accordance with the present invention. In this second preferred embodiment, a generally bow shaped gripper shaft clamping member 21 is attached to a gripper shaft 23 by use of a screw 22 which passes through an aperture in the clamping member 21 and is received in a threaded bore in the upper shaft 23. A gripper housing, generally at 24, which has a semi-circular or bow shape generally similar to the shape of the gripper shaft clamping piece 21 overlies the clamping piece 21. The gripper housing 24 includes a gripper arm 26 with a gripper finger 11. This gripper finger 11 has a gripper finger pressure area 12 which acts on a sheet 13 that is positionable between the gripper finger pressure area 12 and a corresponding abutment surface pressure are 14 which is part of the gripper abutment surface 16.

An elastic member 17 is positioned between the outer circumference of the gripper shaft clamping piece 21 and the inner circumference of the gripper housing 24. This elastic member 17 has a generally semi-circular or semi-cylindrical shape which corresponds to the shapes of the gripper shaft clamping piece 21 and the gripper housing 24. The elastic materials used to fabricate the elastic member 17 and the bonding materials used between the elastic member 7 and the clamping piece 21 and the gripper housing 24 in this second preferred embodiment are similar to that used in the first preferred embodiment. Cross pieces 18 are secured to the ends of the elastic member 17 and act as bearings similarly to the cross pieces 18 discussed with the first embodiment. A set screw 28 is received in a threaded bore in the gripper arm 26 of the gripper housing 24 and exerts a preload force against a butt strap or ear 27 of the gripper shaft clamping member 21.

Figure 5:
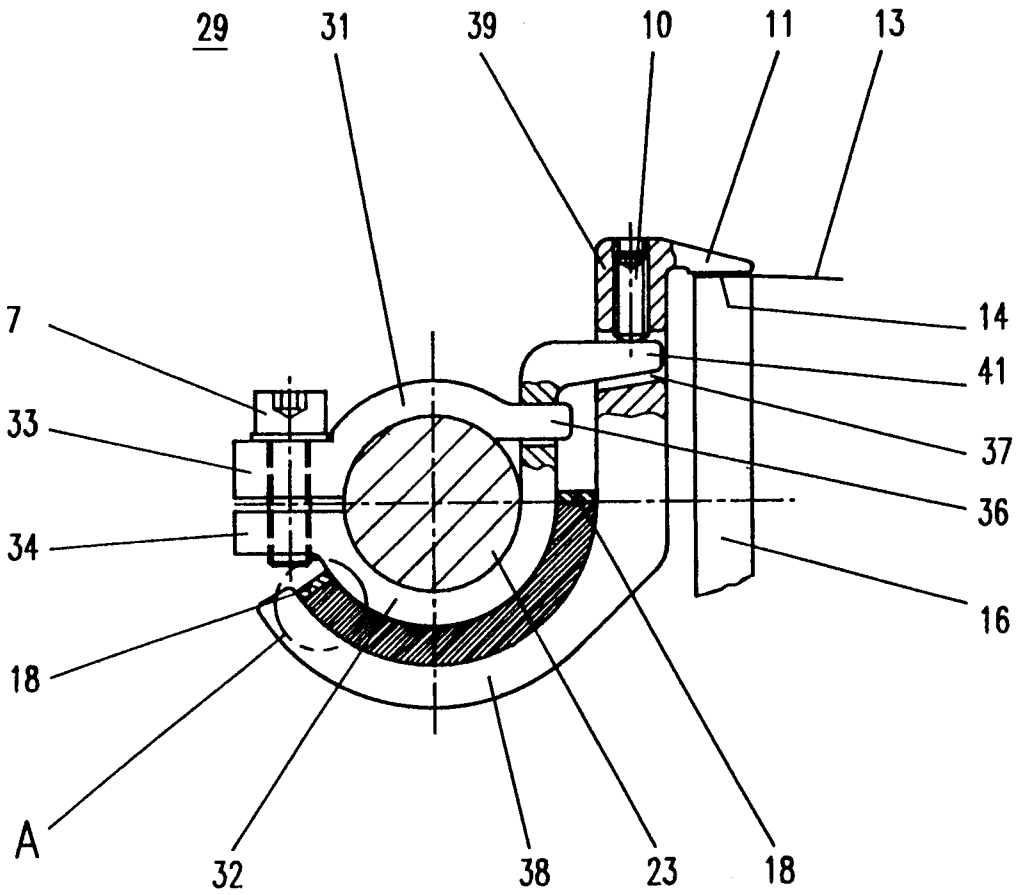
FIG. 5 is a cross-sectional view of a third preferred embodiment of a sheet gripper assembly in accordance with the present invention.

Referring now to FIG. 5, there may be seen, generally at 29, a third preferred embodiment of a sheet gripper assembly in accordance with the present invention. In this third preferred embodiment, there is shown a two piece gripper shaft clamping member. This member includes an upper clamping piece 31 and a lower clamping piece 32. The two pieces 31 and 32 are both formed as segments of a cylinder and are attachable together in encircle a gripper shaft 23. Each of the clamping pieces 31 and 32 has a butt strap or ear 33 and 34, respectively. These butt straps 33 and 34 have alignable threaded apertures which receive a clamping screw 7. The upper clamping piece 31 has an outwardly extending nose 36 which is insertable into a cooperatively shaped recess or aperture in the lower clamping piece 32. This allows the two piece gripper shaft clamping member to be placed around the gripper shaft 23 where it may not be possible to slide the gripper finger assembly onto the gripper shaft from an end of the shaft as is the requirement for the first preferred embodiment, and also allows the gripper finger assembly to be attached to a gripper shaft which does not have a threaded aperture, as is the requirement for the second preferred embodiment.

A gripper housing 38 partially encircles the gripper shaft clamping member. As seen in FIG. 5, the gripper housing has a gripper arm 39 which terminates in a gripper finger 11. The gripper finger 11 has a gripper finger pressure area 12 which contacts a sheet 13 and holds it against an abutment surface pressure area 12 of a gripper abutment surface 16.

An elastic member 17 is positioned between the outer periphery of the lower clamping piece 32 of the two piece gripper shaft clamping member and the inner surface of the gripper housing 38. As was the case in the two previously described embodiments, the particular resilient material used for the elastic member 17 will depend on the use environment. The elastic member is bounded by cross pieces 18 whose structure and function is similar to that discussed in connection with first and second preferred embodiments. Their structure and function will be discussed in greater detail subsequently.

A set screw 10 is received in a threaded bore in the gripper arm 39 of the gripper housing 38. The inner end of this set screw 10 bears against a butt strap or ear 41 which is a part of the lower clamping piece 32 of the two piece gripper shaft clamping member. This butt strap 41 extends into a recess or aperture 37 in the gripper arm 39. Screwing set screw 10 further into the gripper arm 39 will tension the gripper housing 38 against the two piece clamping member by taking up some of the resiliency of the elastic member 17.

Figure 6A:
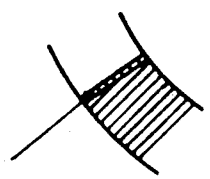
FIG. 6 *a–d* are detailed views of the metallic cross piece in the elastic member showing the encircled area A in FIGS. 1 and 5.
Figure 6B:
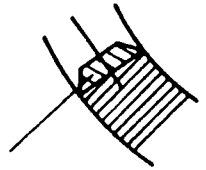
Figure 6C:
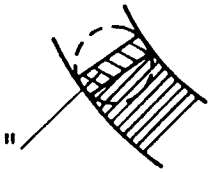
Figure 6D:
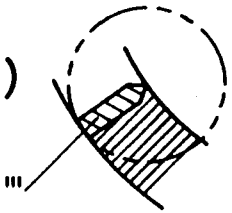

The cross pieces 18 which are attached to the ends of the elastic member 17 and which can also be incorporated into the body of the elastic member 17 as depicted in FIG. 1, have several possible cross-sectional shapes, sa shown in FIGS. **6*a*–6*d*. In FIG. 6*a*, the cross piece 18 is shown having a generally rectangular cross-sectional shape. In FIG. 6*b*, the cross piece 18' has a generally trapezoidal cross-section. The cross piece 18'' shown in FIG. 6*c* has a cross-sectional shape which is formed as a section of a roller with the entire roller indicated in dashed lines in FIG. 6*c*. In FIG. 6*d*, the cross piece 18''' is shaped having a roller section outer end and a knife blade inner end. Again, the shape of the overall ball or roller is depicted in dashed lines in FIG. 6*d*. Since the metal or similar material cross pieces 18 are secured to the elastic member 17, as the end face of the elastic member 17** deflects due to the relative movement between the gripper shaft clamping member and the gripper housing, the cross pieces will act as bearings to facilitate this relative motion.

In the operation of the sheet gripper assembly of the present invention, the springy or resilient support of the gripper finger on the gripper shaft is provided by the elastic member 17. Since the elastic member 17 does not have any free spaces or voids there will not be an accumulation of any waste materials in or on the elastic member 17. When a natural rubber is used for the elastic material that forms the elastic member 17 the advantages are a high tensile strength, good elasticity, and only small wear. Good absorbing characteristics, along with a high tensile strength and elongation at break, accompanied by a good resistance to oils, greases and washing solutions are obtained when a polyurethane having a hardness of 70° to 90° Shore is used as the elastic material in the elastic member 17. In a use environment in which the sheet gripper assembly needs a high aging stability and a high heat resistance, the elastic material for the elastic member 17 may preferably be silicone rubber. When the grippers are used in chain deliveries in machines with dryers it is also advisable to use a silicone rubber due to its ability to tolerate the heat generated by the dryers. The use of a chlorinated rubber, such as chloroprene rubber, as the elastic material in the elastic member 17 is desirable when the sheet grippers are apt to contact oils, greases or washing solutions.

While preferred embodiments of a sheet gripper assembly in accordance with the present invention have been set forth fully and completely hereinabove, it will be apparent to one of skill in the art that a number of changes in, for example the number of gripper fingers secured to a gripper shaft, the particular mechanism utilized to rotate the gripper shaft, the type of support for the gripper shaft and the like can be made without departing from the true spirit and scope of the present invention which is accordingly to be limited only by the following claims.

What is claimed is:

1. A sheet gripper assembly for a sheet-fed rotary printing press, said sheet gripper assembly comprising:

a rotatable gripper shaft;

a gripper shaft clamping member secured to said gripper shaft;

a gripper housing including a gripper arm and a gripper finger supported by said gripper shaft clamping member; and an elastic member interposed between and resiliently securing said gripper housing to said gripper shaft clamping member, said elastic member being concentric with said gripper shaft clamping member and said gripper housing.

2. The sheet gripper assembly of claim 1 wherein said gripper shaft clamping member includes spaced butt straps having alignable threaded bores which receive a clamping screw.

3. The sheet gripper assembly of claim 1 wherein said elastic member includes an elastic material which consists of natural rubber.

4. The sheet gripper assembly of claim 1 wherein said elastic member includes an elastic material which consists of polyurethane.

5. The sheet gripper assembly of claim 1 wherein said elastic member includes an elastic material which consists of silicone rubber.

6. The sheet gripper assembly of claim 1 wherein said elastic member includes an elastic material which consists of chloroprene rubber.

7. The sheet gripper assembly of claim 1 wherein said gripper shaft clamping member includes at least one butt strap and further wherein said gripper finger includes a set screw, an end of said set screw being engageable with said at least one butt strap to apply a preload tension to said gripper arm.

8. The sheet gripper assembly of claim 1 wherein said gripper shaft clamping member and said gripper housing are generally concentric with said gripper shaft.

9. The sheet gripper assembly of claim 1 further including a clamping screw usable to secure said gripper shaft clamping member to said gripper shaft.

10. The sheet gripper assembly of claim 1 wherein said elastic member includes an elastic material selected from the group comprising natural rubber, polyurethane, silicone rubber and chloroprene rubber.

11. A sheet gripper assembly for a sheet-fed rotary printing press, said sheet gripper assembly comprising:

a rotatable gripper shaft;

a gripper shaft clamping member secured to said gripper shaft;

a gripper housing including a gripper arm and a gripper finger supported by said gripper shaft clamping member; and an elastic member interposed between and resiliently securing said gripper housing to said gripper shaft clamping member, said elastic member including cross pieces which extend radially between said gripper shaft clamping member and said gripper housing.

12. The sheet gripper assembly of claim 11 wherein said cross pieces have a rectangular cross section.

13. The sheet gripper assembly of claim 11 wherein said cross pieces have a trapezoidal cross section.

14. The sheet gripper assembly of claim 11 wherein said cross pieces have a roller cross-sectional shaped cross section.

15. The sheet gripper assembly of claim 11 wherein said cross pieces have a roller cross-sectional shaped first end and a knife bearing second end cross section.

16. The sheet gripper assembly of claim 11 wherein first and second of said cross pieces are positioned between said gripper shaft clamping member and said gripper housing at circumferential ends of said elastic member.

17. The sheet gripper assembly of claim 11 wherein said cross pieces act as bearings and facilitate relative movement between said gripper shaft clamping member and said gripper housing.

* * * * *